United States Patent [19]

Suzuki et al.

[11] Patent Number: 4,872,553

[45] Date of Patent: Oct. 10, 1989

[54] MEDICAL FLUID-FILLED PLASTIC CONTAINER AND METHODS OF MAKING SAME

[75] Inventors: Tatsuo Suzuki, Machida; Keinosuke Isono, Kawaguchi, both of Japan

[73] Assignee: Material Engineering Technology Laboratory, Incorporated, Tokyo, Japan

[21] Appl. No.: 139,312

[22] Filed: Dec. 29, 1987

[51] Int. Cl.[4] ..... B65D 85/00

[52] U.S. Cl. ..... 206/524.4; 206/438

[58] Field of Search ..... 206/524.4, 524.5, 438

[56] References Cited

U.S. PATENT DOCUMENTS 3,061,549 10/1962 Dickey ..... 206/524.4
3,820,309 6/1974 Cullen et al. ..... 206/524.4
4,236,633 12/1980 Ernerot ..... 206/524.4
4,295,563 10/1981 Becker et al. ..... 206/524.4
4,466,553 8/1984 Zenger ..... 206/524.8

*Primary Examiner*—Joseph Man-Fu Moy
*Attorney, Agent, or Firm*—Oblon, Spivak, McClelland, Maier & Neustadt

[57] ABSTRACT

Disclosed is a medical fluid-filled plastic container which includes (a) a sealed inner envelope of plastic material filled with a medical fluid containing a component subject to deterioration by oxygen, (b) a deoxidizer, and (c) a sealed outer envelope of plastic material enclosing both the medical fluid-filled inner envelope and the deoxidizer, as well as several methods of making such a medical fluid-filled plastic container. This medical fluid-filled plastic container will prevent the medical fluid therein from being deteriorated even it it is subjected to steam sterilization or is stored for a long period of time.

10 Claims, 3 Drawing Sheets

MEDICAL FLUID-FILLED PLASTIC CONTAINER AND METHODS OF MAKING SAME

BACKGROUND OF THE INVENTION

1. Field of the Invention

This invention relates to a medical fluid-filled plastic container and several methods of making the same. More particularly, it relates to a medical fluid-filled plastic container in which, even if it is subjected to steam sterilization or stored for a long period of time, the medical fluid will not undergo deterioration, as well as several methods of making the same.

2. Description of the Prior Art

In the field of medical treatment, closed systems have recently come to be employed in the infusion of injectable fluids for the purpose of preventing the medical fluid from being exposed to the external environment. As infusion fluid containers for use in such closed systems, conventional glass bottles and glass ampules are being replaced by flexible plastic containers. In the case of such plastic containers, the infusion fluid is discharged under the action of gravity and the flexibility of the container material. This type of medical fluid-filled containers must have sufficient thermal resistance to withstand steam sterilization for the purpose of sterilizing their contents. Moreover, they are preferably formed of a transparent material so that their contents can be monitored from the outside.

Where the medical fluid within such a container contains a component subject to deterioration (such as oxidation) by oxygen, as in the case of highly concentrated amino acid solutions containing tryptophan, elemental diets (hereinafter referred to as EDs), fat emulsions for use by infusion, and infusion fluids containing antibiotics subject to oxidation or hydrolysis in the presence of oxygen, the presence of oxygen in the container or the medical fluid tends to cause deterioration or discoloration of the medical fluid.

Accordingly, it has been conventional practice to fill a plastic container with a medical fluid, replace the oxygen present in the container and the medical fluid by nitrogen gas, and then subject the resulting medical fluid-filled container to steam sterilization. However, it has been difficult to reliably remove the oxygen present in the container and the medical fluid by this method.

Moreover, most of the conventional plastic containers for medical fluids are formed of soft polyvinyl chloride. At ordinary temperatures, soft polyvinyl chloride has low permeability to oxygen gas, but its permeability to gases is still higher than that of glass bottles and glass ampules. Thus, such plastic containers have usually been packaged with a packaging material having good gas barrier properties. Nevertheless, deterioration or discoloration of the medical fluid has been unavoidable because the gas permeability of the packaging material increases during steam sterilization and because oxygen gradually passes through the packaging material and penetrates into the container during long-term storage.

SUMMARY OF THE INVENTION

It is an object of the present invention to provide a medical fluid-filled plastic container in which, even if it is subjected to steam sterilization, the medical fluid will not be deteriorated by the action of oxygen, as well as several methods of making such a medical fluid-filled plastic container.

It is another object of the present invention to provide a medical fluid-filled plastic container in which, even if it is stored for a long period of time, the medical fluid will not be deteriorated by the action of oxygen, as well as several methods of making such a medical fluid-filled plastic container.

According to the present invention, there are provided a medical fluid-filled plastic container comprising (a) a sealed inner envelope of plastic material filled with a medical fluid containing a component subject to deterioration by oxygen, (b) a deoxidizer, and (c) a sealed outer envelope of plastic material enclosing both the medical fluid-filled inner envelope and the deoxidizer, as well as several methods of making such a medical fluid-filled plastic container.

DESCRIPTION OF THE PREFERRED EMBODIMENTS

The medical fluid-filled plastic container of the present invention will be described hereinbelow with reference to the accompanying drawings.

Figure 1:
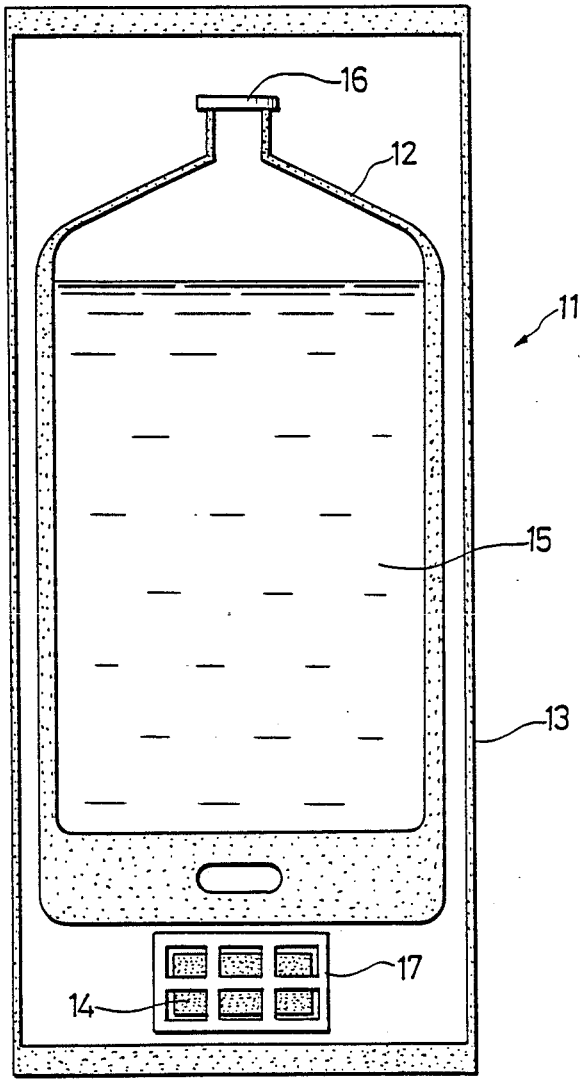
FIG. 1 is a schematic plan view illustrating one embodiment of the medical fluid-filled plastic container of the present invention.

As illustrated in FIG. 1, the medical fluid-filled plastic container 11 of the present invention is basically composed of an inner envelope 12 filled with a medical fluid 15, an outer envelope 13 enclosing the inner envelope 12, and a deoxidizer 14 disposed in the space formed between the inner envelope 12 and the outer envelope 13, i.e., enclosed inside the outer envelope 13 together with the inner envelope 12.

Since the inner envelope 12 is subjected to steam sterilization, it must be formed of a flexible plastic material having sufficient thermal resistance to withstand the sterilization temperature. Moreover, it preferably has high strength, low permeability to water vapor, and good transparency. The plastic materials which can meet these requirements include low-density polyethylene, medium-density polyethylene, linear low-density polyethylene, ethylene-vinyl acetate copolymers and the like.

The medical fluid 15 with which the inner envelope 12 is filled is one containing a component subject to deterioration by oxygen. Specific examples thereof include a highly concentrated amino acid solution containing at least one high-caloric component (i.e., a nutrient component given via the central veins), particularly tryptophan; fat emulsions; elemental diets for use in high-caloric feeding; infusion fluids containing antibiotics subject to oxidation or hydrolysis in the presence of oxygen; and the like.

The deoxidizer 14 may be selected from well-known deoxidizers including powdery deoxidizers comprising metals (such as iron) or metallic halides, and organic deoxidizers consisting essentially of ascorbic acid or catechol. These deoxidizers are commercially available from Mitsubishi Gas Chemical Co., Ltd. under the trade name of Ageless and from several other manufacturers.

The deoxidizer has two functions. One function is to remove the oxygen having passed through the outer envelope so that it may not penetrate into the inner envelope, and the other is to remove the oxygen present in the inner envelope and the medical fluid through the wall of the inner envelope before and during steam sterilization. Thus, it is preferable to use a combination of a self-reacting deoxidizer and a water-dependent deoxidizer. In that case, the self-reacting deoxidizer serves to remove the oxygen present in the outer envelope, the inner envelope and the medical fluid before steam sterilization and, moreover, to remove the oxygen having penetrated into the outer envelope through its material during storage subsequent to the steam sterilization. On the other hand, the water-dependent deoxidizer serves to reliably remove the oxygen present in the inner envelope and the outer envelope, chiefly during steam sterilization, because steam sterilization produces high humidity in the outer envelope and this deoxidizer reacts with the resulting moisture to exhibit its deoxidizing effect.

The deoxidizer should be used in such as amount that, during steam sterilization and during long-term storage, the oxygen concentration in the medical fluid can be kept low enough to prevent the medical fluid from undergoing deterioration (such as oxidation) by oxygen. For example, when the inner envelope is filled with 400 ml of a highly concentrated amino acid solution, the amount of oxygen dissolved in the amino acid solution is at most 4 ml. Accordingly, the deoxidizer must have an oxygen absorption capacity of 4 ml or more. In order to maintain the stability of the amino acid solution during long-term storage, it is preferable to use a deoxidizer having an oxygen absorption capacity equal to ten times the aforesaid value, i.e., 40 ml or more.

The deoxidizer is preferably enclosed in the outer envelope with a space left around the deoxidizer. If the deoxidizer is enclosed in the outer envelope with no space left around the deoxidizer, its effect of removing the oxygen present in the inner envelope, the medical fluid and the outer envelope will be diminished and, therefore, the medical fluid within the inner envelope will be liable to deterioration by oxygen during steam sterilization and during storage. In order to leave a space around the aforesaid deoxidizer, any of various methods may be used. For example, this purpose can be accomplished by enclosing the medical fluid-filled inner envelope and the deoxidizer in the outer envelope together with air or an inert gas; by covering the deoxidizer with a structure having openings extending from one side to the opposite side thereof; by placing the medical fluid-filler inner envelope and the deoxidizer on a corrugated plate and enclosing them in the outer envelope; by providing the inner surface of the outer envelope with projections; or by using an outer envelope comprising a tray and a sheet-like cover.

The outer envelope 13 is preferably formed of a material having good thermal resistance and high impermeability to oxygen gas. More specifically, it is preferable to use a material having an oxygen gas permeability of not greater than 5 $cc/m^2 \cdot 24$ hr atm. Specific examples of such outer envelope materials include three-layer laminated films having a layer formed of a ethylene-vinyl alcohol copolymer film or a polyvinylidene chloride film, and laminated films having an aluminum layer. Although laminated films having an aluminum layer are opaque, they have the advantage that their impermeability to oxygen gas is not affected by humidity. In contrast, three-layer laminated films formed of synthetic resins are transparent and hence permit the medical fluid within the inner envelope to be readily inspected visually for the presence of foreign matter and the degree of deterioration, but their impermeability to oxygen gas is subject to the influence of humidity. Accordingly, where the medical fluid-filled inner envelope is enclosed in an outer envelope comprising such a three-layer laminated film and then subjected to steam sterilization, its outer layer should preferably be formed of a resin (such as polyamide resin) having good thermal resistance and relatively high permeability to water vapor. More specifically, the use of such a resin as the outer layer serves to improve the deoxidizing effect of the aforesaid water-dependent deoxidizer. Moreover, since the intermediate layer comprising an ethylene-vinyl alcohol copolymer film or a polyvinylidene chloride film absorbs moisture during steam sterilization and becomes permeable to oxygen gas, the use of the outer layer formed of a resin having relatively high permeability to water vapor permits the absorbed moisture to be expelled in a short period of time and, as a result, the outer envelope is restored to the original state having high impermeability to oxygen gas in a short period of time. Furthermore, the inner layer of such a three-layer laminated film is preferably formed of a resin having low permeability to water vapor. Then, even if a part of the medical fluid- within the inner envelope penetrates through the wall of the inner envelope, the inner layer formed of a resin having low permeability to water vapor prevents the intermediate layer comprising an ethylene-vinyl alcohol copolymer film or a polyvinylidene chloride film from absorbing an appreciable amount of moisture. Thus, the outer envelope can retain its high impermeability to oxygen gas. Preferably, the inner layer comprises an unoriented polypropylene film or an unoriented polyethylene film because they can provide good heat-sealing properties.

Alternatively, the outer envelope may be formed by using the aforesaid three-layer laminated film on one side and an aluminized laminated film (i.e., the three-layer laminated film in which the ethylene-vinyl alcohol copolymer film layer is replaced by an aluminum layer) on the other side. In the case of an outer envelope comprising a tray and a sheet-like cover, the tray or the sheet-like cover may be formed of the aforesaid three-layer laminated film and the rest may be formed of the aforesaid aluminized laminated film. Thus, one side of the outer envelope, or one of the tray and the sheet-like cover, is transparent, so that not only the resulting medical fluid-filled plastic container can be easily inspected for the presence of foreign matter and the degree of deterioration, but also the oxygen gas impermeability of the outer envelope can be made less susceptible to humidity.

It is known that some medical fluids are subject to deterioration by ultraviolet rays. Accordingly, where the aforesaid transparent three-layer laminated film is used, it is preferable that at least one layer of the three-layer laminated film contain an ultraviolet ray absorbent selected from benzophenone derivatives and phenyl salicylate compounds, or a colorant for rendering it less permeable to ultraviolet rays.

The methods of making a medical fluid-filled plastic container in accordance with the present invention will be described hereinbelow.

A first method comprises (a) charging an inner envelope of plastic material with a medical fluid containing a component subject to deterioration by oxygen in such a way that no dissolved oxygen remains in the medical fluid, and sealing the inner envelope, (b) subjecting the resulting medical fluid-filled inner envelope to steam sterilization under an atmosphere substantially devoid of oxygen; and (c) placing the medical fluid-filled inner envelope, together with a deoxidizer, in an outer envelope of plastic material and sealing the outer envelope.

More specifically, when the inner envelope is charged with the medical fluid, the inner envelope should be sealed after purging the medical fluid and the internal space of the inner envelope of oxygene with an inert gas so as to be substantially devoid of oxygen. This can be accomplished by charging the medical fluid into the inner envelope and then bubbling an inert gas through the medical fluid so that no oxygen remains in the medical fluid and the inner envelope; or by previously purging the medical fluid of oxygene with an inert gas and then charging the medical fluid, together with an inert gas, into the inner envelope so that no oxygen remains in the medical fluid and the inner envelope. Preferably, nitrogen gas is used as the inert gas.

Then, the resulting medical fluid-filled inner envelope is subjected to steam sterilization. This sterilization can be carried out by using an autoclave, a tower autoclave, a rotomat or similar equipment. Where an autoclave is used, the pressure at which steam sterilization is carried out is preferably maintained during subsequent cooling by introducing an inert gas into the atmosphere of the autoclave. Where a tower autoclave or a rotomat is used, the water is preferably purged of dissolved oxygen with an inert gas so that no oxygen will penetrate into the medical fluid-filled inner envelope. Preferably, nitrogen gas is used as the inert gas.

After completion of the sterilization, the medical fluid-filled inner envelope is cooled and then placed in an outer envelope together with a deoxidizer, and the outer envelope is sealed. The space formed between the medical fluid-filled inner envelope and the outer envelope (i.e., the internal space of the outer envelope in which the deoxidizer is disposed) is preferably evacuated or filled with an inert gas such as nitrogen gas.

In this method, steam sterilization and subsequent cooling processes are carried out in an atmosphere substantially devoid of oxygen. As a result, the dissolution of oxygen in the medical fluid can be prevented even when the outer envelope becomes permeable to oxygen gas under the influence of temperature and humidity. Moreover, this method has the advantage that, since the medical fluid-filled inner envelope is sterilized, cooled and then enclosed in the outer envelope, the tendency to blocking between the inner and outer envelopes during sterilization can be eliminated.

A second method comprises (a) charging an inner envelope of plastic material with a medical fluid containing a component subject to deterioration by oxygen, and sealing the inner envelope, (b) placing the medical fluid-filled inner envelope, together with a deoxidizer, in an outer envelope and sealing the outer envelope, and (c) subjecting the resulting medical fluid-filled plastic container to steam sterilization.

In this method, it is preferable to purge the medical fluid and the internal space of the inner envelope of oxygen with an inert gas so as to be substantially devoid of oxygen, and then seal the inner envelope. However, it is to be understood that such purging of oxygen with an inert gas is not essential to the present invention.

The inner envelope is preferably formed of a material having high permeability to oxygen gas and low permeability to water vapor. Among others, linear low-density polyethylene is suitable for this purpose.

Then, the medical fluid-filled inner envelope, together with a deoxidizer, is preferably enclosed in an outer envelope formed of a material having good thermal resistance and high impermeability to oxygen gas, with a space left around the deoxidizer. The reason for this is that, if the deoxidizer is enclosed in the outer envelope with no space left around the deoxidizer, the deoxidizing effect of the deoxidizer is diminished and the medical fluid within the inner envelope is liable to undergo deterioration by oxygen during steam sterilization or storage.

Subsequently, the resulting medical fluid-filled plastic container is subjected to steam sterilization. This sterilization can be carried out by using an autoclave, a tower autoclave, a rotomat or similar equipment. Even if oxygen gas is present in the atmosphere for steam sterilization and the outer envelope is in a state permeable to oxygen gas, the oxygen having penetrated into the outer envelope is removed by the deoxidizer and, therefore, the medical fluid within the inner envelope is protected from deterioration by oxygen. Where an autoclave is used, the pressure at which the steam sterilization is carried out is preferably maintained during subsequent cooling by introducing an inert gas into the atmosphere of the autoclave.

After steam sterilization, it is preferable to positively expel the moisture absorbed in the outer envelope by heating the medical fluid-filled plastic container in a suitable dryer such as an oven. Further, it is more preferable to carry out this drying operation in an atmosphere of an inert gas. More specifically, since the oxygen gas impermeability of the outer envelope is restored in a short period of time when the outer envelope is dried positively, the medical fluid can be prevented from undergoing deterioration (such as oxidation) by oxygen with greater reliability and for a longer period of time.

The present invention will be more specifically described with reference to the accompanying drawings.

Referring now to FIG. 1, a medical fluid-filled plastic container 11 in accordance with the present invention is composed of an inner envelope 12, an outer envelope 13, a deoxidizer 14 and a medical fluid 15. The inner envelope 12 may be formed of any of the previously described flexible plastic materials. However, liner low-density polyethylene having low permeability to water vapor is especially preferred. The inner envelope 12 can be made by any of various methods. For example, it can be made (1) by forming a tubular sheet by tubular film process of linear low-density polyethylene, heat-sealing one open end thereof, making an opening for suspending the medical fluid-filled plastic container, inserting an outlet tube in the other open end, and heat-sealing it; (2) by providing two sheets formed by extrusion of linear low-density polyethylene, superposing one sheet on the other, and heat-sealing their peripheral regions; and (3) by forming a blow-molded article of linear low-density polyethylene so as to have a small-diameter outlet tube at the upper end and a container body connected therewith, and heat-sealing the lateral and/or lower pheripheral regions of the blow-molded article. Among these methods, the one using a blow-molded article is most preferred because the outlet tube is not heat-sealed and, therefore, involves no risk of leakage. The inner envelope 12 used in the embodiment of FIG. 1 is formed in this manner. Through its outlet 16, a medical fluid 15 containing a component subject to deterioration by oxygen is charged into the inner envelope 12. More specifically, the medical fluid 15 is pretreated so as to be substantially devoid of oxygen. At the time of charging, the internal space of the inner envelope 12 is purged of oxygen with nitrogen gas and, immediately after that, the medical fluid 15 is charged thereinto together with nitrogen gas. After charging, the open end of the outlet 16 is hermetically sealed with a plastic material and then provided with a rubber cap. Moreover, in order to maintain the outer surfaces of the rubber cap in a sterile condition, the rubber cap is covered and sealed with a plastic film so that it can be easily removed prior to use.

Then, the inner envelope 12 filled with the medical fluid 15 is enclosed in an outer envelope 13 together with a deoxidizer 14. In this case, the deoxidizer 14 is covered with a structure 17 having openings extending from one side to the opposite side thereof, and then enclosed in the outer envelope 13. The gas present in the outer envelope 13 preferably has a relative humidity of at least 50%.

Subsequently, this medical fluid-filled plastic container 11 is subjected to steam sterilization under an atmosphere comprising steam substantially devoid of oxygen. For example, this sterilization may be carried out by use of an autoclave. More specifically, a plurality of medical fluid-filled plastic containers 11 are placed in an autoclave. Then, steam is supplied from a boiler to the autoclave for a predetermined period of time so as to displace the air present in the autoclave. Thereafter, sterilization is carried out by introducing steam having a predetermined temperature into the autoclave. During this sterilization, the pressure within the autoclave should be kept constant by appropriately introducing an inert gas. On completion of the sterilization, a predetermined amount of cooling water is introduced into the autoclave in order to cool the medical fluid fully. Thereafter, the medical fluid-filled plastic containers are removed from the autoclave.

Figure 2:
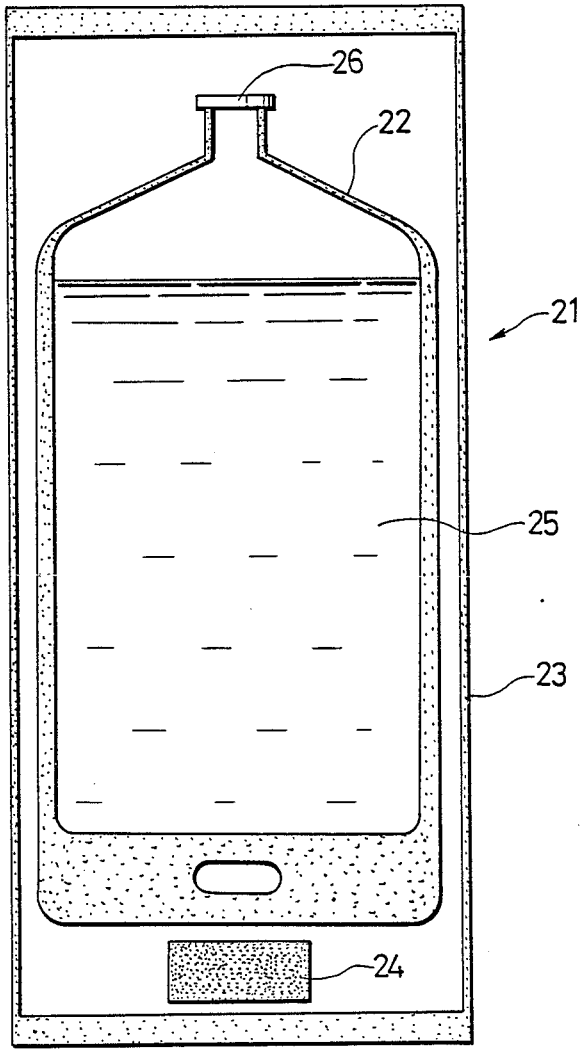
FIGS. 2 and 3 are schematic plan views illustrating other embodiments of the medical fluid-filled plastic container of the present invention.

FIG. 2 illustrates another medical fluid-filled plastic container 21 in accordance with the present invention. This medical fluid-filled plastic container 21 is composed of an inner envelope 22, an outer envelope 23, a deoxidizer 24 and a medical fluid 25. Similar to the inner envelope 12 of FIG. 1, the inner envelope 22 comprises a blow-molded article. Also in the same manner as described in connection with the embodiment of FIG. 1, the medical fluid 25 is charged into the inner envelope 22 by way of its outlet 26.

Then, the inner envelope 22 filled with the medical fluid 25 is subjected to steam sterilization under an atmosphere comprising steam substantially devoid of oxygen. As described above in connection with the embodiment of FIG. 1, this sterilization can be carried out by use of an autoclave. During this sterilization, the pressure within the autoclave should be kept constant by appropriately introducing an inert gas. On completion of the sterilization, a predetermined amount of cooling water is introduced into the autoclave in order to cool the medical fluid fully. During this cooling process, an inert gas is introduced into the autoclave so that the medical fluid-filled inner envelope 22 is cooled under an atmosphere of the inert gas and so that the pressure at which the steam sterilization is carried out is maintained to prevent the medical fluid-filled inner envelope 22 from rupturing.

After cooling, the medical fluid-filled inner envelope 22 and the deoxidizer 24 are placed in the outer envelope 23, which is then sealed. In this case, the inner envelope 23 is preferably filled with nitrogen gas or evacuated.

Figure 3:
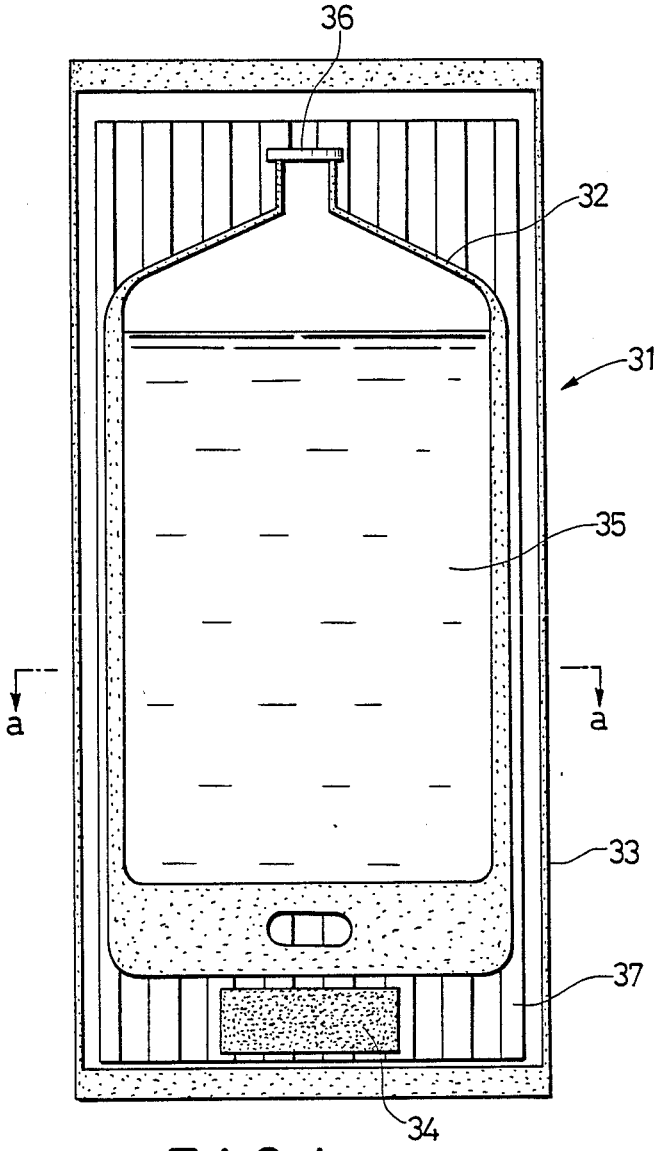
Figure 4:
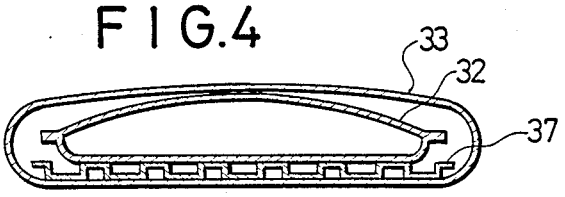
FIG. 4 is a cross-sectional view taken along line a—a of FIG. 3.

A further embodiment is illustrated in FIGS. 3 and 4. In this case, the deoxidizing effect of the deoxidizer 34 can be improved by placing the deoxidizer 34 and the medical fluid-filled inner envelope 32 on a corrugated plate 37 and enclosing them in the outer envelope 33.

The medical fluid-filled plastic containers made in the above-described manner have the following advantageous features.

(1) During sterilization and subsequent storage, the medical fluid within the containers can be protected from deterioration by oxygen and, therefore, can be stored in a stable state.
(2) Since the envelopes are formed of plastic materials, these medical fluid-filled plastic containers are light in weight and convenient for transportation.
(3) Since these medical fluid-filled plastic containers are flexible, they can be used in a closed system for the prevention of air-borne infection.
(4) Since the material of the outer envelope is transparent, the medical fluid within the inner envelope can be easily inspected visually for the presence of foreign matter and the degree of deterioration.

The present invention is further illustrated by the following examples. However, these examples are not to be construed to limit the scope of the invention.

EXAMPLE 1

300 ml of an injectable amino acid solution containing essential amino acids at a concentration of 12% was charged into a bag (inner envelope) formed of linear low-density polyethylene. The amino acid solution and the internal space of the bag were purged with nitrogen gas so as to be substantially devoid of oxygen. Thereafter, the outlet was hermetically sealed with a linear low-density polyethylene film and then provided with a rubber cap. Additionally, the rubber cap was covered and sealed with a polyester film having a blend of polypropylene and polyethylene laminated thereto.

This medical fluid-filled bag was enclosed in a bag (outer envelope) made of a three-layer laminated film comprising an outer layer formed of a biaxially oriented nylon film (20 μm thick), an intermediate layer formed of an ethylene-vinyl alcohol copolymer film (20 μm thick), and an inner layer formed of an unoriented polypropylene film. At the same time, 10 g of a deoxidizer (commercially available from Mitsubishi Gas Chemical Co., Ltd. under the trade name of Ageless) was also enclosed in the outer envelope and nitrogen gas was filled thereinto so that the deoxidizer would not come into close contact with the medical fluid-filled bag or the outer envelope. This outer envelope enclosing the medical fluid-filled bag was subjected to steam sterilization at 115° C. for 40 minutes. During sterilization and subsequent cooling, nitrogen gas was introduced into the autoclave in an amount required to keep the pressure at 1.5 kg/cm$^2$G. After cooling, the outer envelope enclosing the medical fluid-filled bag was taken out. Thus, a medical fluid-filled plastic container was obtained without rupture of the outer envelope.

EXAMPLE 2

A medical fluid-filled bag was prepared in the same manner as described in Example 1. This medical fluid-filled bag was subjected to steam sterilization at 115° C. for 40 minutes. During sterilization and subsequent cooling, nitrogen gas was introduced into the autoclave in an amount required to keep the pressure constant. After cooling, this medical fluid-filled bag was enclosed in an outer envelope made of a three-layer laminated film comprising an outer layer formed of a biaxially oriented polypropylene film (20 μm thick), an intermediate layer formed of a polyvinylidene chloride-coated polyamide film (20 μm thick), and an inner layer formed of an unoriented polypropylene film. At the same time, 10 g of a deoxidizer (commercially available from Mitsubishi Gas Chemical, Ltd. under the trade name of Ageless) was also enclosed in the outer envelope together with air having a relative humidity of 60%. Thus, there was obtained a medical fluid-filled plastic container.

COMPARATIVE EXAMPLE 1

A medical fluid-filled plastic container was made in the same manner as described in Example 1, except that no deoxidizer was used.

REFERENTIAL EXAMPLE 1

A medical fluid-filled plastic container was made in the same manner as described in Example 1, except that the deoxidizer was enclosed in the outer envelope so as to be in close contact with the medical fluid-filled bag and the outer envelope.

REFERENTIAL EXAMPLE 2

A medical fluid-filled plastic container was made in the same manner as described in Example 2, except that the deoxidizer was enclosed in the outer envelope so as to be in close contact with the medical fluid-filled bag and the outer envelope.

In order to inspect the degree of deterioration of the medical fluid enclosed in the medical fluid-filled plastic containers made in the above-described manner, their transmittances to visible light (420 nm) were measured. The results thus obtained are shown in the following table.

| | Transmittance (%) | |
|---|---|---|
| | After storage at 40° C. for 2 weeks. | After storage at 60° C. for 2 months |
| Example 1 | 99.2 | 99.2 |
| Example 2 | 99.1 | 99.0 |
| Comparative Example 1 | 96.3 | 91.8 |
| Referential Example 1 | 97.0 | 94.2 |
| Referential Example 2 | 97.4 | 94.3 |

Obviously, numerous modifications and variations of the present invention are possible in light of the above teachings. It is therefore to be understood that within the scope of the appended claims, the invention may be practiced otherwise than as specifically described herein.

What is claimed is:

1. A fluid-filled plastic container comprising (a) a sealed inner envelope of plastic material filled with a fluid containing a component subject to deterioration by oxygen, said inner envelope including outlet means for changing said fluid into said inner envelope, (b) a deoxidizer, and (c) a sealed outer envelope of plastic material enclosing both said fluid-filled inner envelope and said deoxidizer wherein said deoxidizer comprises a solid deoxidizer which is enclosed in said outer envelope so that a space is left around said solid deoxidizer.

2. A fluid-filled plastic container as claimed in claim 1, wherein said solid deoxidizer comprises a self-reacting deoxidizer and a water dependent deoxidizer.

3. A fluid-filled plastic container as claimed in claim 1 wherein said deoxidizer is covered with a structure having openings extending from one side to the opposite side thereof.

4. A fluid-filled plastic container as claimed in claim 1 wherein said deoxidizer is enclosed in said outer envelope so that said deoxidizer rests on a corrugated plate.

5. A fluid-filled plastic container as claimed in claim 1 wherein said outer envelope is additionally filled with an inert gas.

6. A fluid-filled plastic container as claimed in claim 1 wherein said outer envelope comprises a tray and a sheet-like cover.

7. A fluid-filled plastic container as claimed in claim 1 wherein said inner envelope has a fluid outlet, said outlet is tightly closed with a rubber cap, and said rubber cap is sealed with a plastic film.

8. A fluid-filled plastic container as claimed in claim 1 said inner envelope is formed of a material selected from the group consisting of low-density polyethylene, medium-density polyethylene, linear low-density polyethylene and ethylenevinyl acetate copolymers.

9. A fluid-filled plastic container as claimed in claim 1 wherein at least a part of said outer envelope comprises a three-layer sheet formed of synthetic resins, and said sheet comprises an outer layer formed of a resin having high permeability to water vapor, an intermediate layer formed of a resin having high impermeability to oxygen gas, and an inner layer formed of a resin having low permeability to water vapor.

10. A fluid-filled plastic container as claimed in claim 1 wherein said medical fluid comprise one or more members selected from the group consisting of highly concentrated amino acid solutions containing tryptophan, fat emulsions for use by infusion, elemental diets, and infusion fluids containing antibiotics subject to oxidation or hydrolysis in the presence of oxygen.

* * * * *

UNITED STATES PATENT AND TRADEMARK OFFICE

CERTIFICATE OF CORRECTION

PATENT NO. : 4,872,553

DATED : OCTOBER 10, 1989

INVENTOR(S) : TATSUO SUZUKI ET AL

It is certified that error appears in the above-identified patent and that said Letters Patent is hereby corrected as shown below:

In column 10, line 10, change "changing" to --charging--.

Signed and Sealed this

Fifteenth Day of January, 1991

*Attest:*

HARRY F. MANBECK, JR.

*Attesting Officer*

*Commissioner of Patents and Trademarks*